US006484533B1

(12) United States Patent
Allam et al.

(10) Patent No.: US 6,484,533 B1
(45) Date of Patent: Nov. 26, 2002

(54) METHOD AND APPARATUS FOR THE PRODUCTION OF A LIQUID CRYOGEN

(75) Inventors: Rodney J. Allam, Guildford (GB); Rebecca J. Cotton, New Malden (GB); John Lloyd Dillon, IV, Kutztown, PA (US); Declan P. O'Connor, Chessington (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/705,209

(22) Filed: Nov. 2, 2000

(51) Int. Cl.[7] ..... F25J 3/00
(52) U.S. Cl. ..... 62/643; 62/646
(58) Field of Search ..... 62/643, 646

(56) References Cited

U.S. PATENT DOCUMENTS

| | | | | |
|---|---|---|---|---|
| 5,483,806 A | | 1/1996 | Miller et al. | 62/402 |
| 5,685,173 A | * | 11/1997 | L'Isle et al. | 62/646 |
| 5,901,579 A | * | 5/1999 | Mahoney et al. | 62/646 |
| 5,924,307 A | | 7/1999 | Nenov | 62/643 |

FOREIGN PATENT DOCUMENTS

| | | | |
|---|---|---|---|
| EP | 0672877 | 9/1995 | F25J/3/04 |
| EP | 0880000 | 11/1998 | F25J/3/04 |

OTHER PUBLICATIONS

Brian Keenan and Klaus Reuter, "Meeting the Challenge of Variable Liquid Demands", *BOC Technology*, Nov. 1996 Issue No. 4.

Air Products and Chemicals, Inc. publicity brochure for its range of LPR1 liquid plants titled "Liquid Plants" dated 1980.

* cited by examiner

*Primary Examiner*—Ronald Capossela
(74) *Attorney, Agent, or Firm*—Willard Jones, II

(57) ABSTRACT

A process of liquefying gas to produce a liquid cryogen comprising compressing a gas stream using a compressor, work expanding the compressed gas stream using at least one expansion turbine to produce an expanded gas stream together with power, mechanically transferring the power generated by the expansion turbine(s) to drive the compressor, using the expanded gas stream to provide refrigeration duty for liquefaction, and recycling the cooled expanded compressed gas stream to the compressor.

50 Claims, 5 Drawing Sheets

METHOD AND APPARATUS FOR THE PRODUCTION OF A LIQUID CRYOGEN

INTRODUCTION TO THE INVENTION

The invention relates to the liquefaction of gas to form a cryogen. In particular, the invention relates to an improved method and apparatus for the production of a liquid cryogen from gas by liquefaction.

An important method for the production of liquid cryogen, such as, for example, liquid nitrogen, involves compressing a stream of gas comprising feed gas and recycled gas using a multistage intercooled recycle compressor, cooling the compressed gas, liquefying part of the cooled gas, and work expanding other parts of the gas in one or more expansion turbines to provide heat exchange refrigeration cooling and condensation duty for the process.

It is well known in the art that the use of two expansion turbines operating over different temperature spans, each running at a speed to maximize its performance, is significantly more efficient than the use of a single expansion turbine, due to the closer temperature approaches achieved in the main liquefier heat exchanger. To maximize the overall efficiency of the liquefier, the substantial mechanical power developed by the expansion turbines in producing the refrigeration should be recovered efficiently. For low overall cost, the capital associated with the recovery of the turbine power must be low.

Broadly speaking, there are two methods of recovering the mechanical power generated by expansion turbines. First, it is well known to load expansion turbines with electrical generators thereby recovering the power generated in the form of electricity. However, whilst this method is efficient, such electrical generators are expensive and therefore increase the overall capital cost of the liquefaction process. In addition, an electric generator load expansion turbine usually requires a speed reduction gearbox and mechanical energy is lost in the gearing between the expansion turbine and the electrical generator.

The second method is to recover the power mechanically. For air separation processes, it is known for the mechanical power generated by liquefier expansion turbines to be used to drive a compressor compressing an air separation unit process stream. Such compressor/expander combinations can be a cost effective and efficient means of recovering power developed by a single expander. However, these combinations have the disadvantage of requiring both the expander and the compressor to run at the same speed which is unlikely to be the optimum speed for either component. Further, this combination requires the liquefier expander be associated with the air separation unit feed compressor that is disadvantageous if one wishes to operate the liquefier separately from the air separation unit.

It is also known in the liquefier art to use an expansion turbine to drive a stage of compression, typically to further compress at least part of the gas compressed by the recycle compressor. Such expansion turbine/compressor combinations are sometimes referred to as "companders" and provide about 10–20% of the total compression power. For liquefiers, there is a particular advantage in using an expansion turbine to further compress at least a portion of the gas from the recycle compressor. However, while companders are efficient, they are relatively expensive, require aftercoolers and require instrumentation or controls to prevent then overspeeding. This extra equipment increases the overall cost of the liquefier.

As far as the inventors are aware, there is no prior public disclosure of recovering the turbine power by mounting the turbines on the liquefier recycle compressor or of the advantages derivable therefrom.

An efficient, low cost liquefaction method and apparatus has now been developed in which the power generated by the expansion turbine(s) is recovered in an efficient and cost-effective manner. The improvement results, in particular, in a reduction of the capital cost and ease of construction of liquefiers without sacrificing efficiency.

SUMMARY OF THE INVENTION

According to the first aspect of the present invention, there is provided in a method of liquefying a gas to produce a liquid cryogen comprising:

compressing a gas stream comprising a recycle gas stream in a compressor to provide at least one compressed gas stream;

cooling at least a portion of said compressed gas and work expanding the resultant cooled compressed gas in at least one expansion turbine to provide an expanded gas stream and generate mechanical power;

cooling and at least partially condensing the gas to be liquefied by heat exchange with said expanded gas stream providing refrigeration duty for said cooling and condensation; and recycling without compressing said heat-exchanged expanded gas stream to the compressor to provide said recycle gas stream, the improvement consisting in that the expansion turbine is mechanically linked to the compressor so that the mechanical power generated by said expansion turbine provides a portion of the mechanical power required to drive the compressor.

A feed gas stream may be introduced into the process cycle and introduction can occur at numerous different locations. For example, the feed stream may be combined with the recycle stream prior to compression in the compressor. If the pressure of the feed stream were high enough, it could join newly compressed gas stream downstream from the compressor. If the pressure of the feed stream were at a suitable intermediate pressure then the feed stream could join the cycle as an interstage feed stream to the compressor or be combined with an interstage outlet stream from the compressor. The feed stream may be available as a cryogenic gas and join the circulating fluid at a suitable point inside a cold enclosure. Part of the feed stream may be available as a cryogenic gas and part as a warm gas, each part joining the cycle at an appropriate point.

In certain embodiments of the present invention, the feed stream may never join the circulating stream because it has a different composition. In these embodiments, the feed stream is cooled and condensed to form a product liquid against returning expanded gas streams of the recycling fluid. None of the circulating fluid is condensed. An example would be if the circulating fluid were air and the feed and product streams were nitrogen or if the circulating fluid were standard nitrogen and the feed and the product streams were ultrapure nitrogen.

The feed gas may be any suitable gas that is capable of producing a liquid cryogen. Particular examples of suitable gases include any of the common atmospheric gases such as nitrogen, oxygen and argon, many hydrocarbon gases such as methane and ethane, and mixtures of these gases such as air and natural gas.

The improved method is particularly suitable for liquefaction processes using at least one multistage intercooled integrally geared centrifugal compressor for feed and recycle compression duty assembled with one or more expansion turbines. In particularly preferred embodiments of the invention, expansion turbines drive the compressor via a gear drive.

Preferably, the gas to be liquefied comprises a portion of the compressed gas and the compressed gas comprises make-up and recycle gas. Alternatively, the gas to be liquefied consists of a portion of the compressed gas and said compressed gas comprises make-up gas and recycle gas. In other embodiments, the gas to be liquefied does not comprise recycle gas.

In preferred embodiments of the first aspect of the present invention, there is a single expansion turbine to provide a portion of the mechanical power required to drive the compressor. In this embodiment, the expansion turbine may be mounted opposite the compressor on a single pinion. The expansion turbine may drive the compressor by a dedicated pinion. In a different arrangement, the expansion may be mounted on its own pinion and drive the compressor via a gear drive.

In particularly preferred embodiments, the cooled compressed gas is expanded at different temperatures in at least two expansion turbines, each expansion turbine providing a portion of the mechanical power required to drive the compressor.

There are several different arrangements of the expansion turbines in these particularly preferred embodiments. In one arrangement, the expansion turbines may operate at the same speed and drive the compressor by a gear drive comprising a single pinion common to the expansion turbines. The expansion turbines may then operate at different pressure ratios to provide optimum performance at substantially the same speed. In another arrangement, a first expansion turbine may drive the compressor by a gear drive comprising a first pinion common to the first expansion turbine and the compressor and second expansion turbine may also drive the compressor by a second pinion of the gear drive which is common to the second expansion turbine and the compressor. In a further arrangement, the expansion turbines may operate at different speeds and drive the compressor by a gear drive comprising a separate pinion for each turbine.

The expansion turbine pressure ratios are preferably selected to minimise the difference in the optimum speeds of the two expansion turbines. For optimum expansion turbine aerodynamic efficiency, the expansion turbine wheel should be designed for an optimum wheel tip velocity and an optimum specific speed as is well known in the art.

Efficiency of the present invention is a function of machine geometry, Reynolds Number and Mach Number as well as operating conditions and expansion turbine speed. Both the actual wheel tip velocity and specific speed of an expansion turbine are functions of the expansion turbine speed in revolutions per minute (rpm), the expansion turbine enthalpy drop, the impeller geometry and the exhaust volumetric flow of the expansion turbine. The optimum wheel tip velocity is a function of the isentropic enthalpy drop across the expansion turbine that is, in turn, a function of the expansion turbine pressures and inlet temperature. As is well known in the art, the enthalpy drop reduces with decreasing temperature, but increases with increasing pressure ratio. Thus, to achieve an optimal speed match, the expansion turbine with the colder inlet temperature (the "cold" expansion turbine) should have a larger pressure ratio than the expansion turbine with the warmer inlet temperature (the "warm" expansion turbine).

In embodiments having two expansion turbines mounted on the same pinion, the expansion turbines must run at the same rpm and, ideally, their performances and efficiencies should be as close to optimum as possible. Provided the pressure ratio of the cold expansion turbine is larger than that of the warm expansion turbine, then there are enough variables available to the designer to arrange for both expansion turbines to operate close to their performance and efficiency optima. The variables include the expansion turbine inlet and exhaust pressures and inlet temperatures, the mass flow rate split between the expansion turbines, the impeller geometries and the selected pinion speed at which the two expansion turbines must run.

In a first arrangement of a particularly preferred embodiment having two expansion turbines operating at different temperatures, the compressed gas portion to be cooled and expanded is cooled to a first temperature to provide an "intermediately" cooled compressed gas stream. A portion of the intermediately cooled compressed gas stream is work expanded in a "warm" expansion turbine to provide a first expanded gas stream. A remaining portion of the intermediately cooled compressed gas stream is further cooled to a second temperature below said first temperature to provide a further cooled compressed gas stream that is expanded in a "cold" expansion turbine to provide a second expanded gas stream. Both said first and second expanded gas streams provide cooling and condensation heat-exchange duty.

In this arrangement, the compressor may have a first compression stage and at least one further compression stage, the second expanded gas stream being recycled to the first compression stage and the first expanded gas stream being recycled to a further compression stage.

The "warm" expansion turbine may drive a stage of the compressor by a gear drive comprising a first pinion common to the "warm" expansion turbine and the compression stage and the "cold" expansion turbine may drive a further stage of the compressor by a second pinion of the gear drive which is common to the "cold" expansion turbine and the further compression stage.

In a second arrangement of a particularly preferred embodiment having two expansion turbines providing a portion of the mechanical power required to drive the compressor, the compressed gas portion to be cooled and expanded is cooled to a first temperature to provide an "intermediately" cooled compressed gas stream. The intermediately cooled compressed gas stream is work expanded in a "warm" expansion turbine to provide a first expanded gas stream that is cooled to a second temperature below said first temperature to provide a cooled first expanded gas stream. The cooled first expanded gas stream is work expanded in a "cold" expansion turbine to provide a second expanded gas stream that is used to provide cooling and condensation heat-exchange duty.

The first expanded gas stream need not necessarily be cooled to a second temperature below said first temperature. In some arrangements, the first expanded gas stream may be reheated to the second temperature to produce a reheated first expanded gas stream that is then word expanded in the "cold" expander to provide the second expanded gas stream. In other arrangements, the first expanded gas stream may be fed directly to the "cold" expansion turbine without cooling or reheat.

In the second arrangement, the "warm" expansion turbine may drive the compressor by a gear drive comprising a first pinion common to the "warm" expansion turbine and the compressor and the "cold" expansion turbine may drive the compressor by a second pinion of the gear drive which is common to the "cold" expansion turbine and the compressor.

In a third arrangement of a particularly preferred embodiment of the first aspect of the present invention having two expansion turbines, the compressor has at least one intermediate compression section and a final compression section. The compressed gas portion to be cooled and expanded comprises an intermediate pressure part, withdrawn from the compressor after an intermediate compression section, and a final pressure part, withdrawn from the final compression section. The intermediate pressure part is cooled to a first temperature and work expanded in a "warm" expansion turbine to provide a first expanded gas stream. The final pressure part is cooled to a second temperature below the first temperature and expanded in a "cold" expansion turbine to provide a second expanded gas stream. Both the first and second expanded gas streams provide cooling and condensation heat-exchange duty.

In this arrangement, both the first and second expanded gas streams may be recycled to the first intermediate compression section of the compressor.

The "warm" expansion turbine may drive a stage of the compressor by a gear drive comprising a first pinion common to the "warm" expansion turbine and said compression stage and the "cold" expansion turbine may drive another stage of the compressor by a second pinion of the gear drive which is common to the "cold" expansion turbine and said another compression stage.

In each of these arrangements of a particularly preferred embodiment having two expansion turbines providing a portion of the mechanical power required to drive the compressor, the expansion turbines may operate at the same speed and drive the compressor by a gear drive comprising a single pinion common to the expansion turbines. In this arrangement, the expansion turbines may operate at different pressure ratios to provide optimum performance at substantially the same speed. Alternatively, the expansion turbines may operate at different speeds and drive the compressor by a gear drive comprising a separate pinion for each turbine.

In a particularly preferred embodiment, in a method of liquefying a gas to produce a liquid cryogen comprising:

compressing a combined feed and recycle gas stream in a compressor to provide at least one compressed gas stream;

cooling a portion of the compressed gas and work expanding the resultant cooled compressed gas in at least one expansion turbine to provide an expanded gas stream and generate mechanical power;

cooling and at least partially condensing a remaining portion of the compressed gas by heat exchange with said expanded gas stream providing refrigeration duty for said cooling and condensation; and recycling said heat-exchanged expanded gas stream to the compressor to provide said recycle gas stream, the improvement consisting in that the expansion turbine is mechanically linked to the compressor and the mechanical power generated by said expansion turbine provides a portion of the mechanical power required to drive the compressor.

According to one specific embodiment of the present invention, there is provided a method of liquefying a gas to produce a liquid cryogen comprising:

compressing a recycle gas stream in a compressor having at least a first compression section and a final compression section to provide a compressed gas stream from said final compression section;

cooling a portion of said compressed gas stream to a first temperature to provide an "intermediately" cooled compressed gas stream;

work expanding a portion of said intermediately cooled compressed gas stream in a "warm" expansion turbine to provide a first expanded gas stream, said "warm" expansion turbine being mounted on a pinion that is mechanically linked by a gear drive to the compressor to provide a portion of the mechanical power required to drive the compressor;

further cooling a remaining portion of said intermediately cooled compressed gas stream to a second temperature below said first temperature to provide a further cooled compressed gas stream;

work expanding said further cooled compressed gas stream in a "cold" expansion turbine to provide a second expanded gas stream, said "cold" expansion turbine operating at the same speed as, but with a higher pressure ratio than, the "warm" expansion turbine and also mounted on said pinion to provide a further portion of the mechanical power required to drive the compressor;

cooling and at least partially condensing the remaining portion of said compressed gas stream by heat exchange with said first and second expanded gas streams together providing refrigeration duty for said cooling and condensation thereby providing heat exchanged first and second expanded gas streams;

recycling the heat-exchanged first expanded gas stream to the compressor downstream of the first compression section; and recycling the heat-exchanged second expanded gas stream to the first compression section.

According to another specific embodiment of the present invention there is provided a method of liquefying a gas selected from air and components thereof comprising:

compressing a recycle gas stream in a compressor having an inlet and an outlet to provide a compressed gas stream from said outlet;

cooling a portion of said compressed gas stream to a first temperature to provide an "intermediately" cooled compressed gas stream;

work expanding said intermediately cooled compressed gas stream in a "warm" expansion turbine to provide a first expanded gas stream, said "warm" expansion turbine being mounted on a pinion that is mechanically linked by a gear drive to the compressor to provide a portion of the mechanical power required to drive the compressor;

cooling said first expanded gas stream to a second temperature below said first temperature to provide a cooled first expanded gas stream;

work expanding said cooled first expanded gas stream in a "cold" expansion turbine to provide a second expanded gas stream, said "cold" expansion turbine operating at the same speed as, but with a higher pressure ratio than, the "warm" expansion turbine and also mounted on said pinion to provide a further portion of the mechanical power required to drive the compressor;

cooling and at least partially condensing the remaining portion of said compressed gas stream by heat exchange with said second expanded gas stream together providing refrigeration duty for said cooling and condensation thereby providing a heat exchanged second expanded gas stream; and recycling the heat-exchanged second expanded gas stream to the compressor inlet.

In a further specific embodiment of the present invention there is provided a method of liquefying a gas selected from air and components thereof comprising:

compressing a recycle gas stream in a compressor having at least a first compression section and a final compression section to provide a first compressed gas stream upstream of said final compression section and a second compressed gas stream from said final compression section;

cooling said first compressed gas stream to a first temperature to provide an "intermediately" cooled compressed gas stream;

work expanding said intermediately cooled compressed gas stream in a "warm" expansion turbine to provide a first expanded gas stream, said "warm" expansion turbine being mounted on a pinion that is mechanically linked by a gear drive to the compressor to provide a portion of the mechanical power required to drive the compressor;

cooling a portion of said second compressed gas stream to a second temperature below said first temperature to provide a second cooled compressed gas stream;

work expanding said second cooled compressed gas stream in a "cold" expansion turbine to provide a second expanded gas stream, said "cold" expansion turbine operating at the same speed as, but with a higher pressure ratio than, the warm expansion turbine and also mounted on said pinion to provide a further portion of the mechanical power required to drive the compressor;

cooling and at least partially condensing the remaining portion of said second compressed gas stream by heat exchange with said first and second expanded gas streams together providing refrigeration duty for said cooling and condensation thereby providing heat exchanged first and second expanded gas streams; and recycling both the heat-exchanged first expanded gas stream and the heat-exchanged second expanded gas stream to the first compression section.

In modifications of the aforementioned specific embodiments of the present invention, the "warm" expansion turbine is mounted on a first pinion that is mechanically linked by a gear drive to the compressor and the "cold" expansion turbine is mounted on a second pinion that is mechanically connected by the gear drive to the compressor. Both the "warm" and "cold" expansion turbines provide a portion of the mechanical power to drive the compressor.

In a second aspect of the present invention, there is also provided in an apparatus for liquefying a gas to produce a liquid cryogen comprising:

a compressor for compressing a gas stream comprising a recycle gas stream to provide at least one compressed gas stream;

heat exchange means for cooling at least a portion of the compressed gas;

at least one expansion turbine for work expanding the resultant cooled compressed gas to provide an expanded gas stream and generate mechanical power;

condensing heat exchange means for cooling and at least partially condensing the gas to a liquefied against said expanded gas stream providing refrigeration duty for said cooling and condensation; and recycle conduit means for recycling without compressing said heat-exchanged expanded gas stream to the compressor to provide said recycle stream, the improvement consisting in that said expansion turbine and compressor are mechanically linked so that the expansion turbine provides a portion of the mechanical energy required to drive the compressor.

The compressor is preferably an intercooled integrally geared turbomachine assembly with multiple centrifugal compressor and expansion turbine stages assembled on pinion shafts, driven by a common gear drive, e.g. a bullgear. In embodiments of the invention having pinion shafts, the pinion shafts may have pinion gears that allow the pinion to drive the gear drive.

The expansion turbine and compressor may be connected by a gear drive. Preferably, the expansion turbine is mounted on a dedicated pinion that is linked mechanically to the compressor. However, in a preferred embodiment, the expansion turbine is mounted opposite the compressor on a pinion.

In preferred embodiments of the apparatus aspect of the present invention, there are at least two expansion turbines expanding the cooled compressed gas portion at different temperatures, both expansion turbines being mechanically connected by a gear drive to the compressor.

There are several different arrangements of the preferred embodiments. In one arrangement, a first expansion turbine drives the compressor by a gear drive comprising a first pinion common to the first expansion turbine and the compressor and a second expansion turbine drives the compressor by a second pinion of the gear drive which is common to the second expansion turbine and the compressor.

In a second arrangement, the expansion turbines have a common pinion. Alternatively, the expansion turbines operate at different speeds and drive the compressor by a gear drive comprising a separate pinion for each turbine.

In a particularly preferred embodiment of this aspect of the present invention, the apparatus comprises:

heat exchange means for cooling a compressed gas portion to a first temperature to provide an "intermediately" cooled compressed gas stream;

a "warm" expansion turbine for work expanding a portion of the intermediately cooled compressed gas stream to provide a first expanded gas stream;

heat exchange means for further cooling a remaining portion of the intermediately cooled compressed gas stream to a second temperature below the first temperature to provide a further cooled compressed gas stream; and a "cold" expansion turbine for work expanding the further cooled compressed gas stream to provide a second expanded gas stream, and conduit means for feeding the first and second expanded gas streams to the condensing heat-exchange means.

In this embodiment, the compressor preferably has a first compression section and at least one further compression section. The recycle conduit means preferably recycles the second expanded gas stream to the first compression section and the first expanded gas stream to a further compression section.

A first expansion turbine may drive a stage of the compressor by a gear drive comprising a first pinion common to the first expansion turbine and said compression stage and a second expansion turbine may drive another stage of the compressor by a second pinion of the gear drive which is common to the second expansion turbine and said another compression stage.

Optionally, the two expansion turbines may be mounted opposite each other on the same pinion. Alternatively, where the expansion turbines operate at different speeds, they may drive the compressor by a gear drive comprising a separate pinion for each turbine.

In a second particularly preferred embodiment of this aspect of the present invention, the apparatus comprises:

heat exchange means for cooling a compressed gas portion to a first temperature to provide an "intermediately" cooled compressed gas stream;

a "warm" expansion turbine for work expanding the intermediately cooled compressed gas stream to provide a first expanded gas stream;

heat exchange means for cooling the first expanded gas stream to a second temperature below the first temperature to provide a cooled first expanded gas stream; and a "cold" exchanger for work expanding the cooled first expanded gas stream to provide a second expanded gas stream; and conduit means for feeding said second expanded gas stream to the condensing heat-exchange means.

A first expansion turbine may drive the compressor by a gear drive comprising a first pinion common to the first expansion turbine and the compressor and a second expansion turbine may drive the compressor by a second pinion of the gear drive which is common to the second expansion turbine and the compressor.

Optionally, the two expansion turbines may either be mounted opposite each other on the same pinion or, where the expansion turbines operate at different speeds, they may drive the compressor by a gear drive comprising a separate pinion for each turbine.

Preferably, the apparatus comprises:

heat exchange means for cooling a compressed gas portion to a first temperature to provide an "intermediately" cooled compressed gas stream;

a warm expansion turbine for work expanding said intermediately cooled compressed gas stream to provide a first expanded gas stream;

a "cold" expansion turbine for work expanding said first expanded gas stream to provide a second expanded gas stream; and conduit means for feeding said second expanded gas stream to the condensing heat-exchange means.

In a third particularly preferred embodiment of this aspect of the present invention, the compressor has at least one intermediate compression section and a final compression section providing an intermediate pressure compressed gas steam withdrawn from the compressor after an intermediate compression section and a final pressure compressed gas stream withdrawn from the final compression section of the compressor. The heat exchanger means cools the intermediate pressure compressed gas stream to a first temperature and the final pressure compressed gas stream to a second temperature below the first temperature. A first "warm" expansion turbine work expands the cooled intermediate pressure compressed gas stream to provide a first expanded gas stream and a second "cold" expansion turbine work expands the final pressure compressed gas stream to provide a second expanded gas stream and wherein conduit means feeds said first and second expanded gas streams to the condensing heat-exchange means.

In this preferred embodiment, the recycle conduit means preferably recycles the heat exchanged first and second expanded gas streams to the first compression section of the compressor.

As with the first particularly preferred embodiment of the apparatus aspect, in the third particularly preferred embodiment, a first expansion turbine may drive a stage of the compressor by a gear drive comprising a first pinion common to the first expansion turbine and the compression stage and a second expansion turbine may drive a further stage of the compressor by a second pinion of the gear drive which is common to the second expansion turbine and the further compression stage.

Optionally, the two expansion turbines may either be mounted opposite each other on the same pinion or, where the expansion turbines operate at different speeds, they may drive the compressor by a gear drive comprising a separate pinion for each turbine.

According to a specific embodiment of the apparatus of the present invention, there is provided an apparatus for liquefying a gas selected from air and components thereof comprising:

a compressor having at least a first compression section and a final compression section for compressing a recycle gas stream to provide a compressed gas stream from said final compression section;

heat exchange means for cooling a portion of said compressed gas stream to a first temperature to provide an "intermediately" cooled compressed gas stream;

a "warm" expansion turbine for work expanding a portion of said intermediately cooled compressed gas stream to provide a first expanded gas stream, said "warm" expansion turbine being mounted on a pinion that is mechanically linked by a gear drive to the compressor to provide a portion of the mechanical power required to drive the compressor;

heat exchange means for further cooling a remaining portion of said intermediately cooled compressed gas stream to a second temperature below said first temperature to provide a further cooled compressed gas stream;

a "cold" expansion turbine for work expanding said further cooled compressed gas stream to provide a second expanded gas stream, said "cold" expansion turbine being for operation at the same speed as, but with a higher pressure ratio than, the "warm" expansion turbine and also mounted on said pinion to provide a further portion of the mechanical power required to drive the compressor;

heat exchange means for cooling and at least partially condensing the remaining portion of said compressed gas stream and for said first and second expanded gas streams to together provide refrigeration duty for cooling and condensation to provide heat exchanged first and second expanded gas streams; and recycle conduit means for recycling the heat-exchanged first expanded gas stream to the compressor downstream of the first compression section and recycling the heat-exchanged second expanded gas stream to the first compression section.

According to another specific embodiment of the apparatus of the present invention there is provided an apparatus for liquefying a gas selected from air and components thereof comprising:

a compressor having an inlet and an outlet for compressing a recycle gas stream to provide a compressed gas stream from said outlet;

heat exchange means for cooling a portion of said compressed gas stream to a first temperature to provide an "intermediately" cooled compressed gas stream;

a "warm" expansion turbine for work expanding said intermediately cooled compressed gas stream to provide a first expanded gas stream, said "warm" expansion turbine being mounted on a pinion that is mechanically linked by a gear drive to a compressor to provide a portion of the mechanical power required to drive the compressor;

heat exchange means for cooling said first expanded gas stream to a second temperature below said first temperature to provide a cooled first expanded gas stream;

a "cold" expansion turbine for work expanding said cooled first expanded gas stream to provide a second expanded gas stream, said "cold" expansion turbine being for operation at the same speed as, but with a higher pressure ratio than, the "warm" expansion turbine and also mounted on said pinion to provide a further portion of the mechanical power required to drive the compressor;

heat exchange means for cooling and at least partially condensing the remaining portion of said compressed gas stream against said second expanded gas stream to provide refrigeration duty for said cooling and condensation thereby providing a heat exchanged second expanded gas stream; and recycle conduit means for recycling the heat-exchanged second expanded gas stream to the compressor inlet.

According to another specific embodiment of the apparatus of the present invention there is provided an apparatus for liquefying a gas selected from air and components thereof comprising:

a compressor having at least a first compression section and a final compression section compressing a recycle gas stream to provide a first compressed gas stream upstream of said final compression section and a second compressed gas stream from said final compression section;

heat exchange means for cooling said first compressed gas stream to a first temperature to provide an "intermediately" cooled compressed gas stream; a "warm" expansion turbine for work expanding said intermediately cooled compressed gas stream to provide a first expanded gas stream, said "warm" expansion turbine being mounted on a pinion that is mechanically linked by a gear drive to the compressor to provide a portion of the mechanical power required to drive the compressor;

heat exchange means for cooling a portion of said second compressed gas stream to a second temperature below said first temperature to provide a second cooled compressed gas stream;

a "cold" expansion turbine for work expanding said second cooled compressed gas stream to provide a second expanded gas stream, said "cold" expansion turbine being for operation at the same speed as, but with a higher pressure ratio than, the "warm" expansion turbine and also mounted on said pinion to provide a further portion of the mechanical power required to drive the compressor;

heat exchange means for cooling and at least partially condensing the remaining portion of said second compressed gas stream and for said first and second expanded gas streams to together provide refrigeration duty for cooling and condensation thereby providing heat exchanged first and second expanded gas streams; and recycle conduit means for recycling both the heat-exchanged first expanded gas stream and the heat-exchanged second expanded gas stream to the first compression section.

In alternative embodiments of the aforementioned specific embodiments of the apparatus of the present invention, the "warm" expansion turbine is mounted on a first pinion that is mechanically linked by a gear drive to the compressor and the "cold" expansion turbine is mounted on a second pinion that is mechanically connected by the gear drive to the compressor. Both the "warm" and "cold" expansion turbines provide a portion of the mechanical power to drive the compressor.

By assembling the expansion turbines used in the preferred embodiments of the liquefier process onto the integrally geared centrifugal compressor for the recycle compression service, significant cost reduction can be achieved. Only a single machinery module is required (apart from any feed compressor if required), together with a cold enclosure and piping. This advantage results in a small footprint for the liquefier, a reduction in construction time and facilitates relocation of the liquefier.

If the liquefier uses two expansion turbines then, by mounting the two expansion turbines on a single pinion of the recycle compressor, additional cost reduction can be achieved. In particular, the liquefier has only a single major machine module (other than any feed gas compression if required). Also the aftercoolers are not required thereby further reducing the cost and footprint of the liquefier. Further, as expansion turbines loaded on an integrally geared centrifugal compressor operate at a constant speed, the possibility of overspeeding the expansion turbines is significantly reduced.

A further advantage of the invention is that the number of liquefier equipment modules is reduced because the expansion turbines are mounted on the recycle compressor. This would reduce construction time and reduce the cost of relocation of the liquefier.

DETAILED DESCRIPTION OF THE INVENTION

Figure 1:
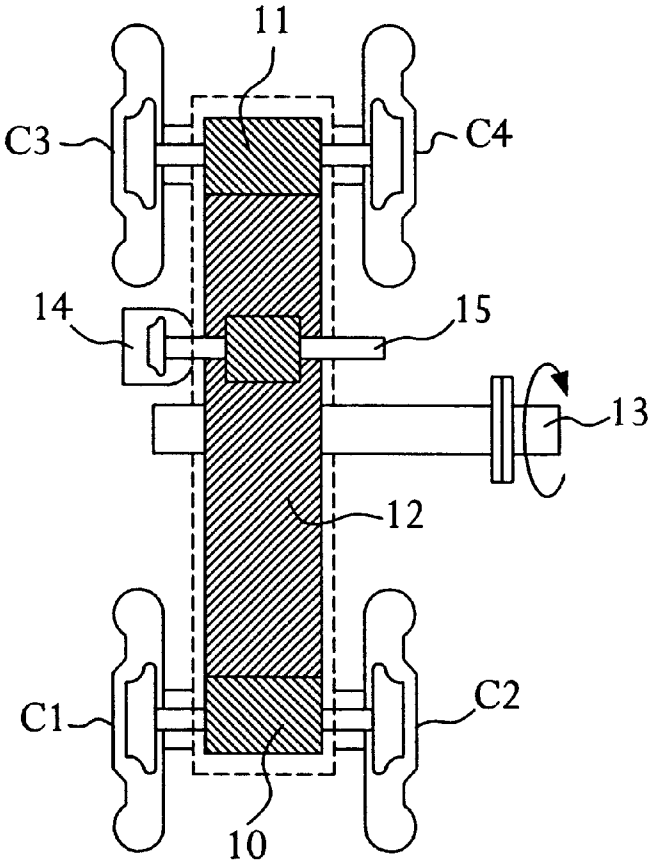
FIG. 1 is a diagrammatic representation of an integrally geared turbomachine having a four-stage centrifugal compressor and a single expansion turbine.

In FIG. 1, a first-stage C1 of a compressor is mounted opposite a second-stage C2 of the compressor on a first compressor pinion shaft 10. A third-stage 3 of the compressor is mounted opposite a fourth-stage 4 of the compressor on a second compressor pinion shaft 11. The first and second compressor pinion shafts are mechanically connected by an integrally geared turbomachine gear (or bullgear) 12. A majority portion of the mechanical power required to drive the compressor stages is provided to the bull gear by a drive shaft 13.

An expansion turbine 14 is mounted on an expansion turbine pinion shaft 15 that is mechanically connected to the bull gear. The expansion turbine provides the remaining portion of the mechanical power required to drive the four stages of the compressor.

Figure 2:
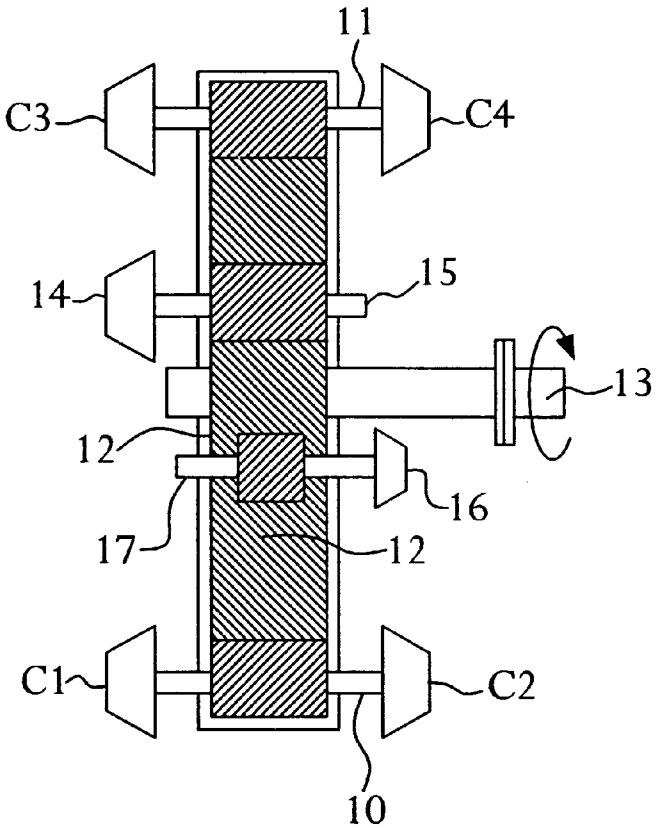
FIG. 2 is a diagrammatic representation of a first arrangement of the gear drive between a four-stage centrifugal compressor and two expansion turbines.

An integrally geared turbomachine assembly comprising the four stages C1–C4 of the compressor on the pinions shafts 10, 11, the bull gear 12 and the drive shaft 13 in FIG. 2 is the same as that shown in FIG. 1. In FIG. 2, the expansion turbine 14, mounted on a first expansion turbine pinion shaft 15, is a "warm" expansion turbine. A second expansion turbine 16, referred to as a "cold" expansion turbine as it operates at a lower temperature than the first expansion turbine, is mounted on a second expansion turbine pinion shaft 17 that is mechanically connected to the bull gear. In this arrangement, the "warm" and the "cold" expansion turbines combine to provide the remaining portion of the mechanical power required to drive the four stages of the compressor.

Figure 3:
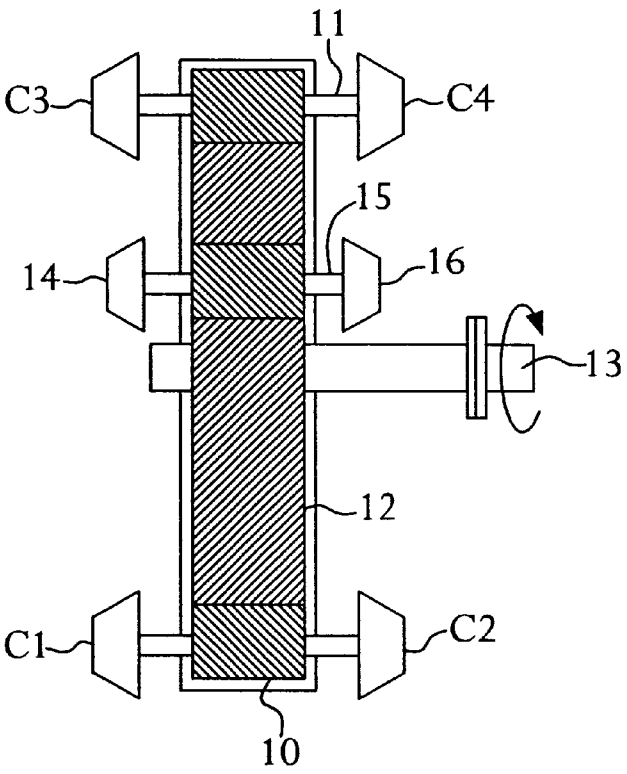
FIG. 3 is a diagrammatic representation of a second arrangement of the gear drive between a four-stage centrifugal compressor and two expansion turbines.

An integrally geared turbomachine assembly comprising the four stages C1–C4 of the compressor on the pinion shafts 10, 11, the bullgear 12 and the drive shaft 13 in FIG. 3 is the same as that shown in FIGS. 1 and 2. In FIG. 3, the "warm" expansion turbine 14 is mounted opposite the "cold" expansion turbine 16 on the expansion turbine pinion shaft 15 that is mechanically connected to the bullgear. In this arrangement, the "warm" and the "cold" expansion turbines combine to provide the remaining portion of the mechanical power required to drive the four stages of the compressor.

Figure 4:
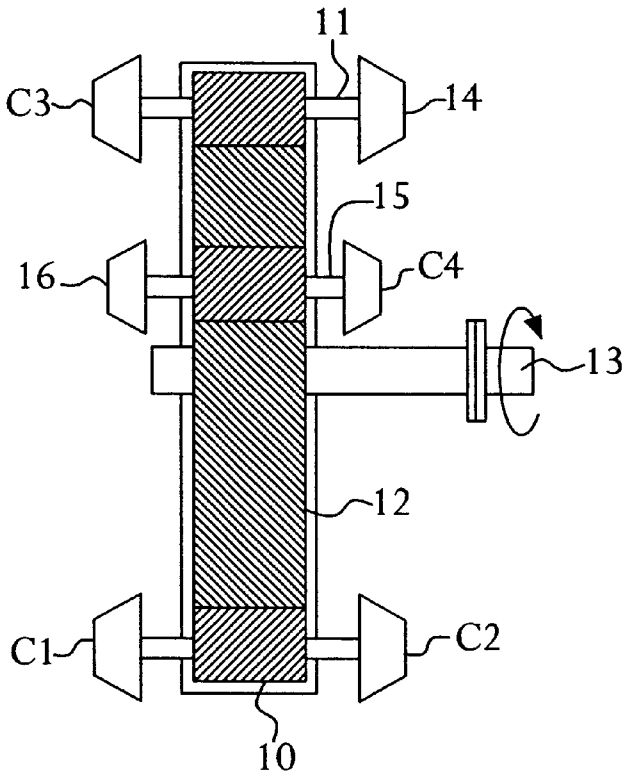
FIG. 4 is a diagrammatic representation of a third arrangement of the gear drive between a four-stage centrifugal compressor and two expansion turbines.

An integrally geared turbomachine assembly comprising the first and second stages C1, C2 of the compressor mounted on the compressor pinion shaft 10, the bullgear 12 and the drive shaft 13 is the same as that shown in FIGS. 1, 2 and 3. However, in FIG. 4, the "warm" expansion turbine 14 is mounted opposite the third-stage C3 of the compressor on the compressor pinion shaft 11. In addition, the fourth-stage C4 of the compressor is mounted opposite the "cold" expansion turbine 16 on the expansion turbine pinion shaft 15. The compressor pinion shaft and the expansion turbine pinion shaft are mechanically connected to the bullgear. The stages of the compressor are driven by the mechanical power provided by the drive shaft combined with the mechanical power provided by the turbines.

Figure 5:
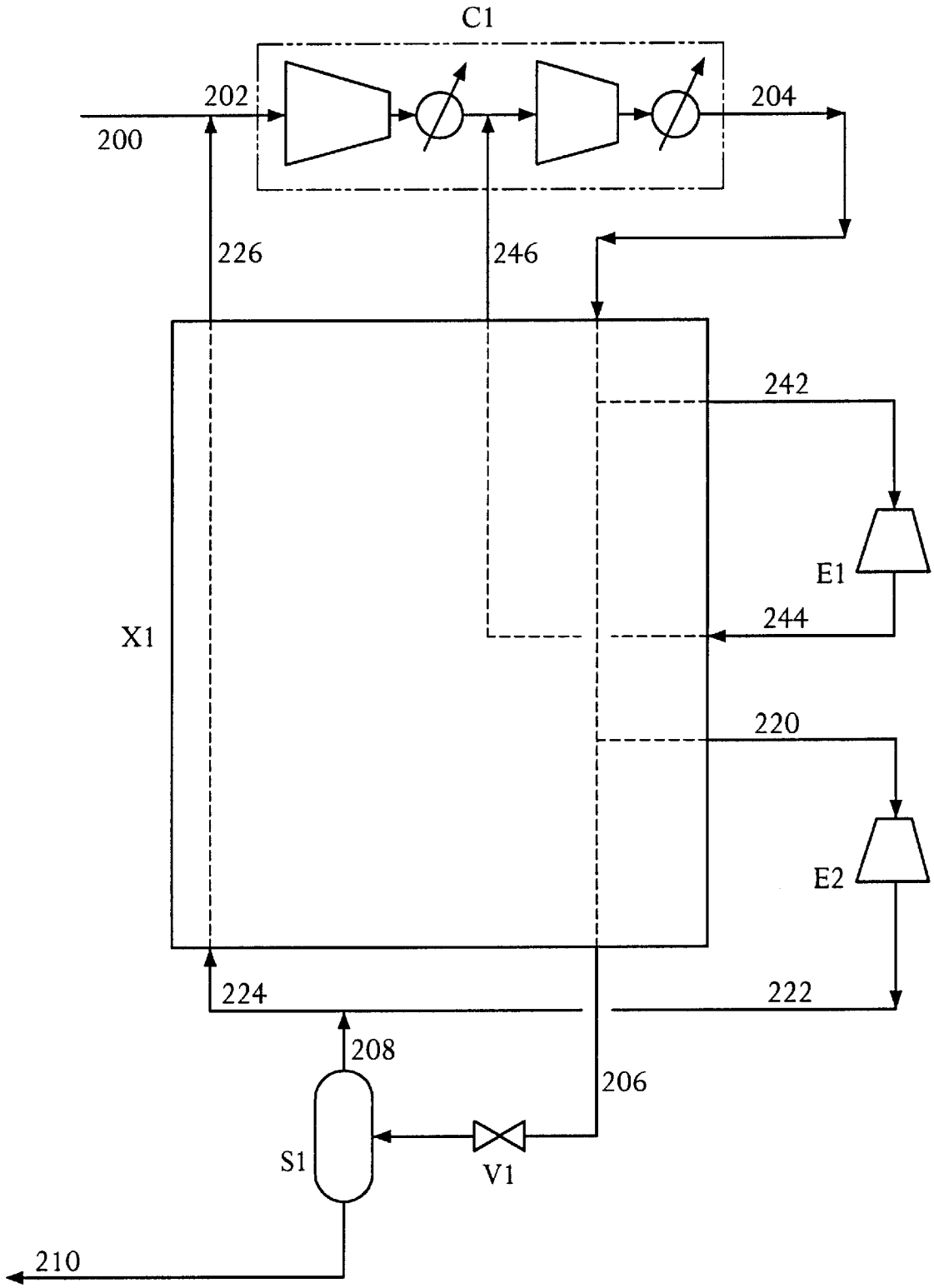
FIG. 5 is a schematic representation of the first arrangement of a particularly preferred embodiment of the present invention.

In FIG. 5, a cold expansion turbine E2 operates between the first-stage suction and final discharge pressures of the compressor C and a warm expansion turbine E1 operates between an intermediate compression section sidestream pressure and the final discharge pressure of the compressor C.

A feed gas stream 200 is combined with a recycle gas stream 226 taken from the cold enclosure of a heat exchanger X1 and is compressed by a recycle compressor C to provide a compressed gas stream 204. Stream 204 is cooled to a first intermediate temperature in the heat exchanger X1. A portion of the cooled compressed gas stream is withdrawn from the heat exchanger X1 as stream 242 and flows to the inlet of a warm expansion turbine E1. A stream 244 of expanded gas is exhausted from the expansion turbine E1 and fed to the heat exchanger X1 where it is warmed by providing cooling and condensation duty. The warmed stream is removed from the heat exchanger X1 and is then recycled as intermediate compression section feed stream 246 to the recycle compressor C.

A remaining portion of the compressed gas stream cooled to a first intermediate temperature is further cooled in the heat exchanger X1 to a second intermediate temperature that is colder than the first intermediate temperature. The further cooled stream is divided into at least two portions. A first portion is removed from the heat exchanger X1 and flows as stream 220 to the inlet of a cold expansion turbine E2 and is expanded. A stream of expanded gas is exhausted from the outlet of the cold expansion turbine E2 as expanded gas stream 222 where it is combined with a vapour fraction 208 taken from a separator S1; described below. A stream of partially condensed expanded gas may be fed directly to the separator. The combined stream 224 is then fed to the heat exchanger X1 in which it is warmed by providing condensation duty. The warmed gas is then recycled by being fed as stream 226 to the feed gas stream 200.

A remaining portion of the compressed gas stream cooled to the second intermediate temperature is further cooled in the heat exchanger X1 and flows from the heat exchanger X1 as stream 206. Stream 206 is fed via a Joule-Thompson valve V1 where it is expanded and the expanded stream flows to a separator S1 in which it is separated into vapour and liquid fractions. The vapour fraction is removed from the separator S1 as stream 208 and is combined with expanded gas stream 222. The liquid fraction flows from the separator S1 as a liquid product stream 210.

The liquid product stream 210 could be subcooled against a vaporising portion of the liquid product as is well known in the art.

The expansion turbines E1 and E2 may be mounted on the same pinion or on separate pinions mechanically connected to the compressor C. The pressure of stream 244 originating from the outlet of the warm expansion turbine E1 and fed as an intermediate compression section feed to the compressor C is selected to minimise the difference in the optimum speeds of the two expansion turbines.

Figure 6:
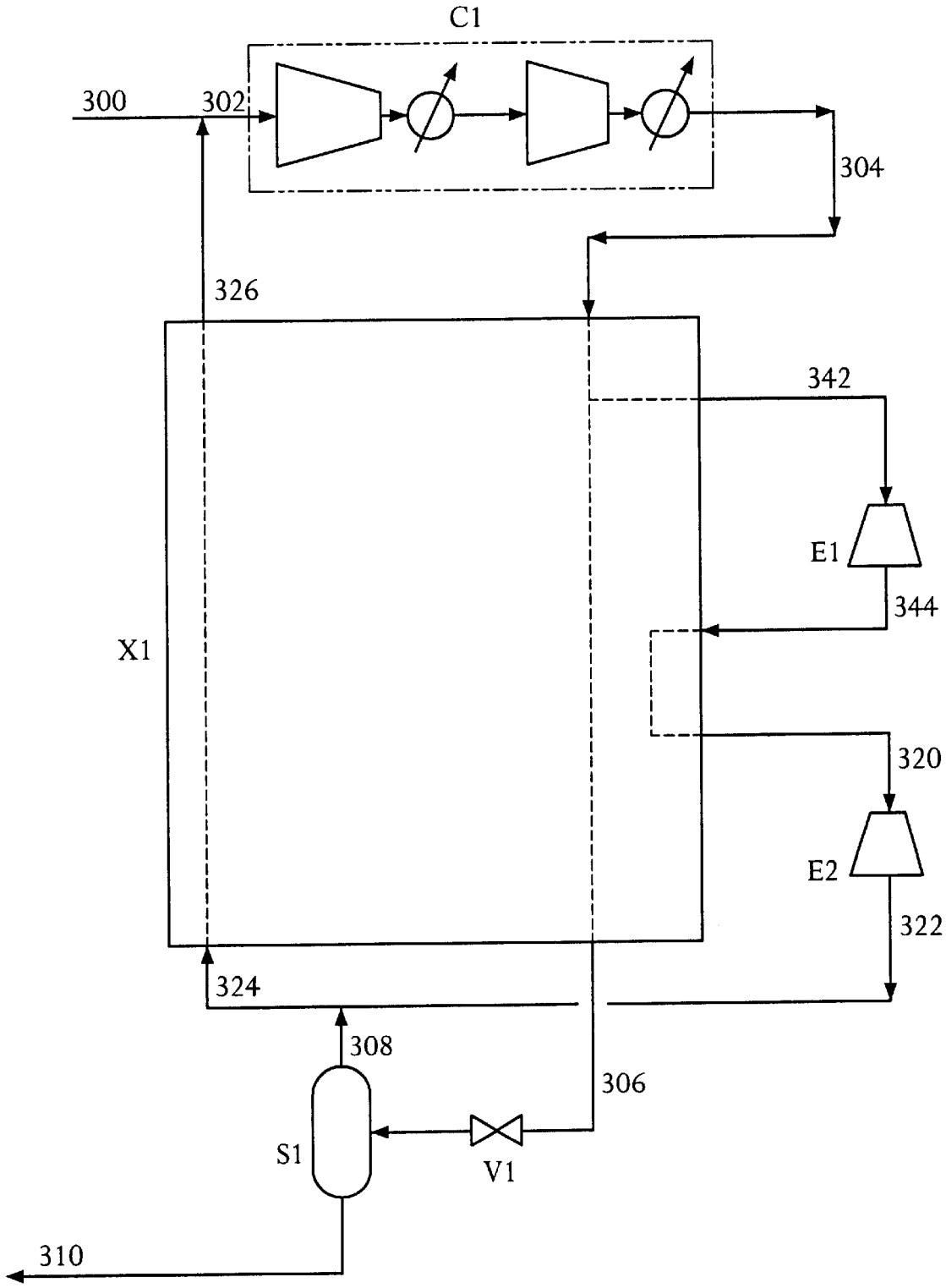
FIG. 6 is a schematic representation of the second arrangement of a particularly preferred embodiment of the present invention.

In FIG. 6, a cold expansion turbine E2 and a warm expansion turbine E1 are combined in series and the combination operates between the first stage suction and final discharge pressures of a compressor C.

A feed gas stream 300 is combined with a recycle gas stream 326 from the cold enclosure of a heat exchanger X1 and is compressed to provide a compressed gas stream 304. Compressed gas stream 304 is cooled in the heat exchanger X1 to a first intermediate temperature. A portion of the cooled compressed gas stream is withdrawn from the heat exchanger X1 and passed as cooled gas stream 342 to the inlet of a warm expansion turbine E1. A stream 344 of expanded gas is exhausted from the expansion turbine E1 and is returned to the heat exchanger X1 where it is cooled to a second intermediate temperature, wherein the second intermediate temperature is colder than the first intermediate temperature, and provides warming duty. The cooled gas stream is removed from the heat exchanger X1 and fed as stream 320 to the inlet of a cold expansion turbine E2. A stream of expanded gas is removed from the outlet of the expansion turbine E2 as expanded gas stream 322, combined with a vapour stream 308 from a separator S1, discussed below and the combined stream 324 is fed to the heat exchanger X1 whereupon stream 324 is warmed by providing condensation duty. The warmed gas is recycled by being fed as stream 326 to the feed gas stream 300.

A remaining portion of the compressed gas stream cooled to a first intermediate temperature is further cooled in the heat exchanger X1 to a third intermediate temperature (colder than the second intermediate temperature) and is removed from the heat exchanger X1 as stream 306. Stream 306 is pressure-reduced across a Joule-Thompson valve V1 and flows into a separator S1 whereupon it is separated into liquid and vapour fractions. The vapour fraction is removed from the separator 31 as stream 308 and is combined with the expanded gas stream 322 from the outlet of the cold expansion turbine E2. The combined gas stream 324 is then recycled as described above. The liquid fraction is removed from the separator S1 as liquid product stream 310.

The liquid product stream 310 could be subcooled against a vaporising portion of the liquid product as is well known in the art.

The expansion turbines E1 and E2 may be mounted on a single pinion common to both turbines or on separate pinions. In either case, the pinions are mechanically connected to the compressor C. The intermediate pressure between the two expansion turbines determines the pressure ratios of the two expansion turbines and is selected to minimise the difference in the optimum speeds of the two expansion turbines. In this particular example, the pressure ratio across the cold expansion turbine E2 is greater than that across the warm expansion turbine E1.

Figure 7:
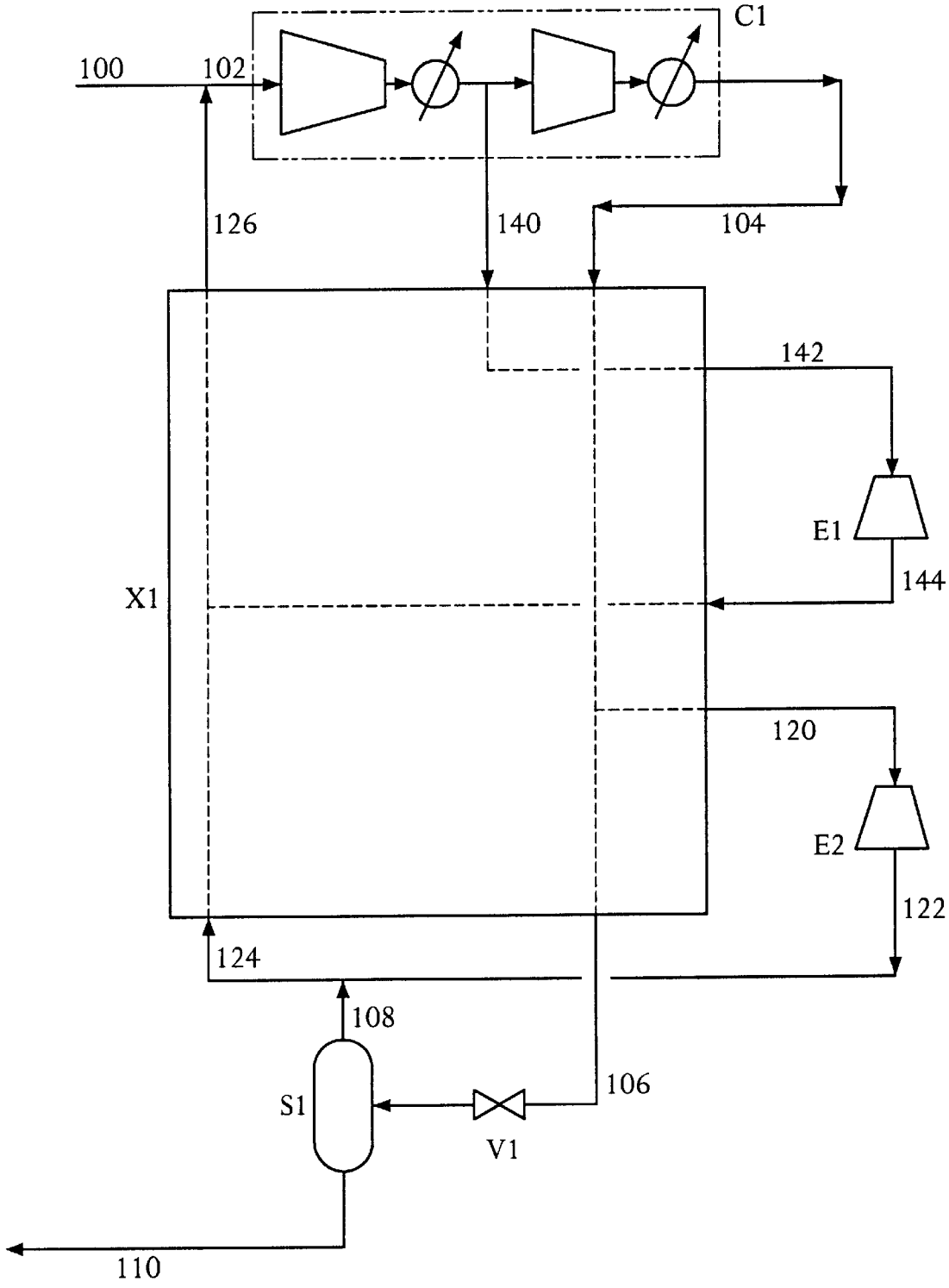
FIG. 7 is a schematic representation of the third arrangement of a particularly preferred embodiment of the present invention.

In FIG. 7, a cold expansion turbine E2 operates between the first stage suction and final discharge pressures of the recycle compressor C and a warm expansion turbine E1 operates between an intermediate compression section pressure and the first stage suction pressure of the compressor C.

A feed gas stream 100 is combined with a recycle gas stream 126 from a cold enclosure of the heat exchanger X1 and is compressed to an intermediate pressure by a first compression section of a compressor C. A stream 140 of intermediate pressure compressed gas discharges from an intermediate section of the compressor C and cooled in the heat exchanger X1 to a first intermediate temperature and then passed as a cooled stream 142 to the inlet of a warm expansion turbine E1. A stream 144 of expanded gas exhausts from the outlet of the expansion turbine E1 and is returned to the heat exchanger X1 where it is combined with a cooling stream 124 of gas originating from the exhaust of expansion turbine E2 and the combined stream provides cooling and condensation duty. The warmed gas stream is recycled by being fed as stream 126 to the feed gas stream 100.

A remaining portion of the intermediate pressure compressed gas is further compressed in a high-pressure compression section of the recycle compressor C and is discharged from the recycle compressor C as stream 104. Compressed gas stream 104 is cooled in the heat exchanger X1 to a second intermediate temperature, the second intermediate temperature being colder than the first intermediate temperature. A portion of the compressed gas stream at the second intermediate temperature is removed from the heat exchanger X1 as stream 120 and is fed to the inlet of a cold expansion turbine E2. A stream of expanded gas exhausts from expansion turbine E2 as expanded gas stream 122 where it is combined with a vapour fraction 108 taken from a separator S1; described below. The combined stream 124 is then fed to the heat exchanger X1 in which it is warmed by providing condensation duty. The warmed gas stream 126 is then recycled as described above.

A remaining portion of the compressed gas stream at the second intermediate temperature is further cooled in the heat exchanger X1 and is withdrawn from the heat exchanger as stream 106. Stream 106 is reduced in pressure across a Joule-Thompson valve V1 and then fed to the separator S1 in which it is separated into vapour and liquid fractions. The vapour fraction is removed from the separator S1 as stream 108 and is combined with expanded gas stream 122. The liquid fraction is removed from the separator S1 as a liquid product stream 110.

Liquid product stream 110 may be subcooled against a vaporising portion of the liquid product as is well known in the art.

The expansion turbines E1 and E2 may be mounted opposite each other on the same pinion or on separate pinions. In either case, the pinions are mechanically connected to the compressor C. The pressure of stream 140 withdrawn from an intermediate section of compressor C, may be selected to minimise the difference in the optimum speeds of the expansion turbines.

EXAMPLE 1

An example of the invention for a nitrogen liquefier using the gear drive arrangement depicted in FIG. 3 in the process of FIG. 5 is as follows:

The recycle compressor has four stages two each on two pinions, with the intermediate compression section feed joining the gas exiting the second section intercooler. The two expansion turbines are mounted opposite each other on a third recycle compressor pinion.

| Stream | Flowrate [Kgmol/h] | Pressure [BarA (MPa)] | Temperature [° C.] |
|---|---|---|---|
| 200 | 96.8 | 9.0 (0.9) | 20.0 |
| 226 | 351.7 | 9.0 (0.9) | 19.5 |
| 246 | 375.5 | 30.4 (3.0) | 19.5 |
| 204 | 824.0 | 56.0 (5.6) | 20.0 |
| 242 | 375.5 | 55.8 (5.6) | −42.2 |
| 244 | 375.5 | 30.6 (3.0) | −75.9 |
| 220 | 316.1 | 55.8 (5.6) | −95.4 |
| 222 | 316.1 | 9.2 (0.9) | −162.8 |
| 208 | 13.2 | 9.2 (0.9) | −170.6 |
| 210 | 96.8 | 9.2 (0.9) | −170.6 |

warm expansion turbine speed = 50000 rpm and isentropic efficiency = 84.3% and impeller diameter 83 mm
cold expansion turbine speed = 50000 rpm and isentropic efficiency = 82.8% and impeller diameter 85 mm The liquid nitrogen product stream 210 could be subcooled against a vaporising portion of the liquid nitrogen in ways well known in the art.

Relatively high expansion turbine efficiencies can be achieved for this small liquifier, even with the constraint that the two expansion turbines run at the same speed on a third pinion of the recycle compressor. This is achievable because the cold expansion turbine pressure ratio is optimally higher than that of the warm expansion turbine.

It will be appreciated that the invention is not restricted to the details described above with reference to the preferred embodiments but that numerous modifications and variations can be made without departing from the scope of the invention as defined by the followings claims.

What is claimed is:

1. A method of liquefying a gas to produce a liquid cryogen comprising:

compressing a gas stream comprising a recycle gas stream in a compressor to provide at least one compressed gas stream;

cooling at least a portion of said compressed gas stream to a first temperature;

work expanding said cooled compressed gas stream in a "warm" expansion turbine to provide a first expanded gas stream, said warm expansion turbine being mechanically linked to the compressor to provide a portion of the mechanical power required to drive the compressor;

cooling a compressed gas stream, selected from a remaining portion of said compressed gas stream and said first expanded gas stream, to a second temperature below said first temperature to provide a further cooled compressed gas stream;

work expanding said further cooled compressed gas stream in a "cold" expansion turbine to provide a second expanded gas stream, said cold expansion turbine being mechanically linked to the compressor to provide a further portion of the mechanical power required to drive the compressor;

cooling and at least partially condensing the gas to be liquefied by heat exchange with an expanded gas stream, selected from said first and second expanded gas streams, providing refrigeration duty for said cooling and condensation thereby producing a heat-exchanged expanded gas stream; and recycling said heat-exchanged expanded gas stream to the compressor.

2. The method of claim 1, wherein said gas to be liquefied comprises a portion of the compressed gas and said compressed gas comprises make-up and recycle gas.

3. The method of claim 1, wherein said gas to be liquefied consists of a portion of the compressed gas and said compressed gas comprises make-up and recycle gas.

4. The method of claim 1, wherein said gas to be liquefied does not comprise recycle gas.

5. The method of claim 1, wherein the gas to be liquefied is selected from air and components thereof.

6. The method of claim 1, wherein said expansion turbines operate at the same speed and drive the compressor by a gear drive comprising a single pinion common to the expansion turbines.

7. The method of claim 6, wherein the expansion turbines operate at different pressure ratios to provide optimum performance at substantially the same speed.

8. The method of claim 1, wherein the warm expansion turbine drives the compressor by a gear drive comprising a first pinion common to the warm expansion turbine and the compressor and the cold expansion turbine drives the compressor by a second pinion of the gear drive which is common to the cold expansion turbine and the compressor.

9. The method of claim 1, wherein said expansion turbines operate at different speeds and drive the compressor by a gear drive comprising a separate pinion for each turbine.

10. A method of liquefying a gas to produce a liquid cryogen comprising:

compressing a gas stream comprising a recycle gas stream in a compressor to provide at least one compressed gas stream;

cooling at least a portion of said compressed gas stream to a first temperature to provide an "intermediately" cooled compressed gas stream;

work expanding a portion of said intermediately cooled compressed gas stream in a "warm" expansion turbine to provide a first expanded gas stream, said warm expansion turbine being mechanically linked to the compressor to provide a portion of the mechanical power required to drive the compressor;

cooling a remaining portion of said intermediately cooled compressed gas stream to a second temperature below said first temperature to provide a further cooled compressed gas stream:

work expanding said further cooled compressed gas stream in a "cold" expansion turbine to provide a second expanded gas stream, said cold expansion turbine being mechanically linked to the compressor to provide a further portion of the mechanical power required to drive the compressor;

cooling and at least partially condensing the gas to be liquefied by heat exchange with said first and second expanded gas streams together providing refrigeration duty for said cooling and condensation thereby producing heat-exchanged first and second expanded gas streams; and recycling said first and second heat-exchanged expanded gas streams to the compressor.

11. The method of claim 10, wherein the compressor has a first compression section and at least one further compression section; the second expanded gas stream is recycled to the first compression section; and the first expanded gas stream is recycled to a further compression section.

12. The method of claim 10, wherein said expansion turbines operate at the same speed and drive the compressor by a gear drive comprising a single pinion common to the expansion turbines.

13. The method of claim 12, wherein the expansion turbines operate at different pressure ratios to provide optimum performance at substantially the same speed.

14. The method of claim 10, wherein said expansion turbines operate at different speeds and drive the compressor by a gear drive comprising a separate pinion for each turbine.

15. A method of liquefying a gas to produce a liquid cryogen comprising:

compressing a gas stream comprising a recycle gas stream in a compressor to provide at least one compressed gas stream;

cooling at least a portion of said compressed gas stream to a first temperature to provide an "intermediately" cooled compressed gas stream;

work expanding said intermediately cooled compressed gas stream in a "warm" expansion turbine to provide a first expanded gas stream, said warm expansion turbine being mechanically linked to the compressor to provide a portion of the mechanical power required to drive the compressor;

cooling said first expanded gas stream to a second temperature below said first temperature to provide a cooled first expanded gas stream;

work expanding said cooled first expanded gas stream in a "cold" expansion turbine to provide a second expanded gas stream, said cold expansion turbine being mechanically linked to the compressor to provide a further portion of the mechanical power required to drive the compressor;

cooling and at least partially condensing the gas to be liquefied by heat exchange with said second expanded gas stream providing refrigeration duty for said cooling and condensation thereby producing a heat-exchanged second expanded gas stream; and recycling said second heat-exchanged expanded gas stream to the compressor.

16. The method of claim 15, wherein said expansion turbines operate at the same speed and drive the compressor by a gear drive comprising a single pinion common to the expansion turbines.

17. The method of claim 16, wherein the expansion turbines operate at different pressure ratios to provide optimum performance at substantially the same speed.

18. The method of claim 15, wherein said expansion turbines operate at different speeds and drive the compressor by a gear drive comprising a separate pinion for each turbine.

19. A method of liquefying a gas to produce a liquid cryogen comprising:

compressing a gas stream comprising a recycle gas stream in a compressor having at least one intermediate compression section and a final compression section to provide an intermediate pressure compressed gas stream withdrawn from the compressor after an intermediate compression section and a final pressure compressed gas stream withdrawn from the compressor after the final compression section;

cooling said intermediate pressure compressed gas stream to a first temperature;

work expanding said cooled intermediate pressure compressed gas stream in a "warm" expansion turbine to provide a first expanded gas stream, said warm expansion turbine being mechanically linked to the compressor to provide a portion of the mechanical power required to drive the compressor;

cooling said final pressure compressed gas stream to a second temperature below said first temperature to provide a further cooled compressed gas stream;

work expanding said further cooled compressed gas stream in a "cold" expansion turbine to provide a second expanded gas stream, said cold expansion turbine being mechanically linked to the compressor to provide a further portion of the mechanical power required to drive the compressor;

cooling and at least partially condensing the gas to be liquefied by heat exchange with said first and second expanded gas streams together providing refrigeration duty for said cooling and condensation thereby producing heat-exchanged first and second expanded gas streams; and recycling said first and second heat-exchanged expanded gas streams to the compressor.

20. The method of claim 19, wherein both said first and second expanded gas streams are recycled to the first intermediate compression section of the compressor.

21. The method of claim 19, wherein said expansion turbines operate at the same speed and drive the compressor by a gear drive comprising a single pinion common to the expansion turbines.

22. The method of claim 21, wherein the expansion turbines operate at different pressure ratios to provide optimum performance at substantially the same speed.

23. The method of claim 19, wherein said expansion turbines operate at different speeds and drive the compressor by a gear drive comprising a separate pinion for each turbine.

24. An apparatus for liquefying a gas comprising:

a compressor for compressing a recycle gas stream to provide at least one compressed gas stream;

heat exchange means for cooling at least a portion of said compressed gas stream to a first temperature;

a "warm" expansion turbine for work expanding said cooled compressed gas stream to provide a first expanded gas stream;

drive means mechanically linking said warm expansion turbine to the compressor to provide a portion of the mechanical power required to drive the compressor;

heat exchange means for further cooling a compressed gas stream, selected from a remaining portion of said compressed gas stream and said expanded first gas stream, to a second temperature below said first temperature to provide a further cooled compressed gas stream;

a "cold" expansion turbine for work expanding said further cooled compressed gas stream to provide a second expanded gas stream;

drive means mechanically linking said cold expansion turbine to the compressor to provide a further portion of the mechanical power required to drive the compressor;

condensing heat exchange means for cooling and at least partially condensing the gas to be liquefied against an expanded gas stream to provide refrigeration duty for said cooling and condensation thereby producing a heat exchanged expanded gas stream;

conduit means for feeding an expanded gas stream, selected from said first and second expanded gas streams, to said condensing heat exchange means, and recycle conduit means for recycling said heat-exchanged expanded gas stream to the compressor.

25. The apparatus of claim 24, wherein the expansion turbines have a common pinion.

26. The apparatus of claim 24, wherein the warm expansion turbine drives the compressor by a gear drive comprising a first pinion common to the warm expansion turbine and the compressor and the cold expansion turbine drives the compressor by a second pinion of the gear drive which is common to the second expansion turbine and the compressor.

27. The apparatus of claim 24, wherein the expansion turbines operate at different speeds and drive the compressor by a gear drive comprising a separate pinion for each turbine.

28. An apparatus for liquefying a gas comprising:

a compressor for compressing a recycle gas stream to provide at least one compressed gas stream;

heat exchange means for cooling at least a portion of said compressed gas stream to a first temperature to provide an "intermediately" cooled compressed gas stream;

a "warm" expansion turbine for work expanding a portion of said intermediately cooled compressed gas stream to provide a first expanded gas stream;

drive means mechanically linking said warm expansion turbine to the compressor to provide a portion of the mechanical power required to drive the compressor;

heat exchange means for further cooling a remaining portion of said intermediately cooled compressed gas stream to a second temperature below said first temperature to provide a further cooled compressed gas stream;

a "cold" expansion turbine for work expanding said further cooled compressed gas stream to provide a second expanded gas stream;

drive means mechanically linking said cold expansion turbine to the compressor to provide a further portion of the mechanical power required to drive the compressor;

heat exchange means for cooling and at least partially condensing the gas to be liquefied against an expanded gas stream to provide refrigeration duty for said cooling and condensation thereby producing a heat exchanged expanded gas stream;

conduit means for feeding said first and second expanded gas streams to said condensing heat-exchange means and recycle conduit means for recycling said first and second heat-exchanged expanded gas streams to the compressor.

29. The apparatus of claim 28, wherein the compressor has a first compression section and at least one further compression section; and the recycle conduit means recycles the second expanded gas stream to the first compression section and the first expanded gas stream to a further compression section.

30. The apparatus of claim 28, wherein said expansion turbines have a common pinion.

31. The apparatus of claim 29, wherein the expansion turbines operate at different speeds and drive the compressor by a gear drive comprising a separate pinion for each turbine.

32. An apparatus for liquefying a gas comprising:

a compressor for compressing a recycle gas stream to provide at least one compressed gas stream;

heat exchange means for cooling at least a portion of said compressed gas stream to a first temperature to provide an "intermediately" cooled compressed gas stream;

a "warm" expansion turbine for work expanding a portion of said intermediately cooled compressed gas stream to provide a first expanded gas stream;

drive means mechanically linking said warm expansion turbine to the compressor to provide a portion of the mechanical power required to drive the compressor;

heat exchange means for further cooling said first expanded gas stream to a second temperature below said first temperature to provide a cooled first expanded gas stream;

a "cold" expansion turbine for work expanding said cooled first expanded gas stream to provide a second expanded gas stream;

drive means mechanically linking said cold expansion turbine to the compressor to provide a further portion of the mechanical power required to drive the compressor;

heat exchange means for cooling and at least partially condensing the gas to be liquefied against an expanded gas stream to provide refrigeration duty for said cooling and condensation thereby producing a heat exchanged expanded gas stream;

conduit means for feeding said second expanded gas stream to said condensing heat-exchange means and recycle conduit means for recycling said heat-exchanged expanded gas stream to the compressor.

33. The apparatus of claim 32, wherein said expansion turbines have a common pinion.

34. The apparatus of claim 32, wherein the expansion turbines operate at different speeds and drive the compressor by a gear drive comprising a separate pinion for each turbine.

35. An apparatus for liquefying a gas comprising:

a compressor having at least one intermediate compression section and a final compression section for compressing a recycle gas stream to provide an intermediate pressure compressed gas stream withdrawn from the compressor after an intermediate compression section and a final pressure compressed gas stream withdrawn from the final compression stage;

heat exchange means for cooling said intermediate pressure compressed gas stream to a first temperature to provide a cooled intermediate pressure compressed gas stream;

a "warm" expansion turbine for work expanding said cooled intermediate pressure compressed gas stream to provide a first expanded gas stream;

drive means mechanically linking said warm expansion turbine to the compressor to provide a portion of the mechanical power required to drive the compressor;

heat exchange means for cooling said final pressure compressed gas stream to a second temperature below said first temperature to provide a cooled final pressure compressed gas stream;

a "cold" expansion turbine for work expanding said cooled final pressure compressed gas stream to provide a second expanded gas stream;

drive means mechanically linking said cold expansion turbine to the compressor to provide a further portion of the mechanical power required to drive the compressor;

condensing heat exchange means for cooling and at least partially condensing the gas to be liquefied against an expanded gas stream to provide refrigeration duty for said cooling and condensation thereby producing a heat exchanged expanded gas stream;

conduit means for feeding said first and second expanded gas streams, to said condensing heat exchange means, and recycle conduit means for recycling said first and second heat-exchanged expanded gas streams to the compressor.

36. The apparatus of claim 35, wherein the recycle conduit means recycles said heat exchanged first and second expanded gas streams to the first compression section of the compressor.

37. The apparatus of claim 35, wherein said expansion turbines have a common pinion.

38. The apparatus of claim 35, wherein the expansion turbines operate at different speeds and drive the compressor by gear drive comprising a separate pinion for each turbine.

39. A method of liquefying a gas selected from air and components thereof comprising:

compressing a combined feed and recycle gas stream in a compressor having at least a first compression section and a final compression section to provide a compressed gas stream from said final compression section;

cooling a portion of said compressed gas stream to a first temperature to provide an "intermediately" cooled compressed gas stream;

work expanding a portion of said intermediately cooled compressed gas stream in a "warm" expansion turbine to provide a first expanded gas stream, said "warm" expansion turbine being mounted on a pinion that is mechanically linked by a gear drive to the compressor to provide a portion of the mechanical power required to drive the compressor;

further cooling a remaining portion of said intermediately cooled compressed gas stream to a second temperature below said first temperature to provide a further cooled compressed gas stream;

work expanding said further cooled compressed gas stream in a "cold" expansion turbine to provide a second expanded gas stream, said "cold" expansion turbine operating at the same speed as, but with a higher pressure ratio than, the "warm" expansion turbine and also mounted on said pinion to provide a further portion of the mechanical power required to drive the compressor;

cooling and at least partially condensing the remaining portion of said compressed gas stream by heat exchange with said first and second expanded gas streams together providing refrigeration duty for said cooling and condensation thereby producing heat-exchanged first and second expanded gas streams;

recycling the heat-exchanged first expanded gas stream to the compressor downstream of the first compression section; and recycling the heat-exchanged second expanded gas stream to the first compression section.

40. A method of liquefying a gas selected from air and components thereof comprising:

compressing a combined feed and recycle gas stream in a compressor having at least a first compression section and a final compression section to provide a compressed gas stream from said final compression section;

cooling a portion of said compressed gas stream to a first temperature to provide an "intermediately" cooled compressed gas stream;

work expanding a portion of said intermediately cooled compressed gas stream in a "warm" expansion turbine to provide a first expanded gas stream, said "warm" expansion turbine being mounted on a first pinion that is mechanically linked by a gear drive to the compressor to provide a portion of the mechanical power required to drive the compressor;

further cooling a remaining portion of said intermediately cooled compressed gas stream to a second temperature below said first temperature to provide a further cooled compressed gas stream;

work expanding said further cooled compressed gas stream in a "cold" expansion turbine to provide a second expanded gas stream, said "cold" expansion turbine being mounted on a second pinion that is mechanically linked by the gear drive to the compressor to provide a further portion of the mechanical power required to drive the compressor;

cooling and at least partially condensing the remaining portion of said compressed gas stream by heat exchange with said first and second expanded gas streams together providing refrigeration duty for said cooling and condensation thereby producing heat-exchanged first and second expanded gas streams;

recycling the heat-exchanged first expanded gas stream to the compressor downstream of the first compression section; and recycling the heat-exchanged second expanded gas stream to the first compression section.

41. A method of liquefying a gas selected from air and components thereof comprising:

compressing a combined feed and recycle gas stream in a compressor having an inlet and an outlet to provide a compressed gas stream from said outlet;

cooling a portion of said compressed gas stream to a first temperature to provide an "intermediately" cooled compressed gas stream;

work expanding said intermediately cooled compressed gas stream in a "warm" expansion turbine to provide a first expanded gas stream, said "warm" expansion turbine being mounted on a pinion that is mechanically linked by a gear drive to the compressor to provide a portion of the mechanical power required to drive the compressor;

cooling said first expanded gas stream to a second temperature below said first temperature to provide a cooled first expanded gas stream;

work expanding said cooled first expanded gas stream in a "cold" expansion turbine to provide a second expanded gas stream, said "cold" expansion turbine operating at the same speed as, but with a higher pressure ratio than, the "warm" expansion turbine and also mounted on said pinion to provide a further portion of the mechanical power required to drive the compressor;

cooling and at least partially condensing the remaining portion of said compressed gas stream by heat exchange with said second expanded gas stream together providing refrigeration duty for said cooling and condensation thereby producing a heat exchanged second expanded gas stream; and recycling the heat-exchanged second expanded gas stream to the compressor inlet.

42. A method of liquefying a gas selected from air and components thereof comprising:

compressing a combined feed and recycle gas stream in a compressor having an inlet and an outlet to provide a compressed gas stream from said outlet;

cooling a portion of said compressed gas stream to a first temperature to provide an "intermediately" cooled compressed gas stream;

work expanding said intermediately cooled compressed gas stream in a "warm" expansion turbine to provide a first expanded gas stream, said "warm" expansion turbine being mounted on a first pinion that is mechanically linked by a gear drive to the compressor to provide a portion of the mechanical power required to drive the compressor;

cooling said first expanded gas stream to a second temperature below said first temperature to provide a cooled first expanded gas stream;

work expanding said cooled first expanded gas stream in a "cold" expansion turbine to provide a second expanded gas stream, said "cold" expansion turbine being mounted on a second pinion that is mechanically linked by the gear drive to the compressor to provide a further portion of the mechanical power required to drive the compressor;

cooling and at least partially condensing the remaining portion of said compressed gas stream by heat exchange with said second expanded gas stream providing refrigeration duty for said cooling and condensation to produce a heat-exchanged second expanded gas stream; and recycling the heat-exchanged second expanded gas stream to the compressor inlet.

43. A method of liquefying a gas selected from air and components thereof comprising:

compressing a combined feed and recycle gas stream in a compressor having at least a first compression section and a final compression section to provide a first compressed gas stream upstream of said final compression section and a second compressed gas stream from said final compression section;

cooling said first compressed gas stream to a first temperature to provide an "intermediately" cooled compressed gas stream;

work expanding said intermediately cooled compressed gas stream in a "warm" expansion turbine to provide a first expanded gas stream, said "warm" expansion turbine being mounted on a pinion that is mechanically linked by a gear drive to the compressor to provide a portion of the mechanical power required to drive the compressor;

cooling a portion of said second compressed gas stream to a second temperature below said first temperature to provide a second cooled compressed gas stream;

work expanding said second cooled compressed gas stream in a "cold" expansion turbine to provide a second expanded gas stream, said "cold" expansion turbine operating at the same speed as, but with a higher pressure ratio than, the warm expansion turbine and also mounted on said pinion to provide a further portion of the mechanical power required to drive the compressor;

cooling and at least partially condensing the remaining portion of said second compressed gas stream by heat exchange with said first and second expanded gas streams together providing refrigeration duty for said cooling and condensation thereby producing heat exchanged first and second expanded gas streams; and recycling both the heat-exchanged first expanded gas stream and the heat-exchanged second expanded gas stream to the first compression section.

44. A method of liquefying a gas selected from air and components thereof comprising:

compressing a combined feed and recycle gas stream in a compressor having at least a first compression section and a final compression section to provide a first compressed gas stream upstream of said final compression section and a second compressed gas stream from said final compression section;

cooling said first compressed gas stream to a first temperature to provide an "intermediately" cooled compressed gas stream;

work expanding said intermediately cooled compressed gas stream in a "warm" expansion turbine to provide a first expanded gas stream, said "warm" expansion turbine being mounted on a pinion that is mechanically linked by a gear drive to the compressor to provide a portion of the mechanical power required to drive the compressor;

cooling a portion of said second compressed gas stream to a second temperature below said first temperature to provide a second cooled compressed gas stream;

work expanding said second cooled compressed gas stream in a "cold" expansion turbine to provide a second expanded gas stream, said "cold" expansion turbine being mounted on a second pinion that is mechanically linked to the compressor by the gear drive to provide a further portion of the mechanical power required to drive the compressor;

cooling and at least partially condensing the remaining portion of said second compressed gas stream by heat exchange with said first and second expanded gas streams together providing refrigeration duty for said cooling and condensation thereby producing heat exchanged first and second expanded gas streams; and recycling both the heat-exchanged first expanded gas stream and the heat-exchanged second expanded gas stream to the first compression section.

45. An apparatus for liquefying a gas selected from air and components thereof comprising:

a compressor having at least a first compression section and a final compression section for compressing a combined feed and recycle gas stream to provide a compressed gas stream from said final compression section;

heat exchange means for cooling a portion of said compressed gas stream to a first temperature to provide an "intermediately" cooled compressed gas stream;

a "warm" expansion turbine for work expanding a portion of said intermediately cooled compressed gas stream to provide a first expanded gas stream, said "warm" expansion turbine being mounted on a pinion that is mechanically linked by a gear drive to the compressor to provide a portion of the mechanical power required to drive the compressor;

heat exchange means for further cooling a remaining portion of said intermediately cooled compressed gas stream to a second temperature below said first temperature to provide a further cooled compressed gas stream;

a "cold" expansion turbine for work expanding said further cooled compressed gas stream to provide a second expanded gas stream, said "cold" expansion turbine being for operation at the same speed as, but with a higher pressure ratio than, the "warm" expansion turbine and also mounted on said pinion to provide a further portion of the mechanical power required to drive the compressor;

heat exchange means for cooling and at least partially condensing the remaining portion of said compressed gas stream against said first and second expanded gas streams to together provide refrigeration duty for said cooling and condensation to provide heat exchanged first and second expanded gas streams; and recycle conduit means for recycling the heat-exchanged first expanded gas stream to the compressor downstream of the first compression section and recycling the heat-exchanged second expanded gas stream to the first compression section.

46. An apparatus for liquefying a gas selected from air and components thereof comprising:

a compressor having at least a first compression section and a final compression section for compressing a combined feed and recycle gas stream to provide a compressed gas stream from said final compression section;

heat exchange means for cooling a portion of said compressed gas stream to a first temperature to provide an "intermediately" cooled compressed gas stream;

a "warm" expansion turbine for work expanding a portion of said intermediately cooled compressed gas stream to provide a first expanded gas stream, said "warm" expansion turbine being mounted on a first pinion that is mechanically linked by a gear drive to the compressor to provide a portion of the mechanical power required to drive the compressor;

heat exchange means for further cooling a remaining portion of said intermediately cooled compressed gas stream to a second temperature below said first temperature to provide a further cooled compressed gas stream;

a "cold" expansion turbine for work expanding said further cooled compressed gas stream to provide a second expanded gas stream, said "cold" expansion turbine being mounted on a second pinion that is mechanically linked by the gear drive to the compressor to provide a further portion of the mechanical power required to drive the compressor;

heat exchange means for cooling and at least partially condensing the remaining portion of said compressed gas stream against said first and second expanded gas streams to together provide refrigeration duty for said cooling and condensation to provide heat exchanged first and second expanded gas streams; and recycle conduit means for recycling the heat-exchanged first expanded gas stream to the compressor downstream of the first compression section and recycling the heat-exchanged second expanded gas stream to the first compression section.

47. An apparatus for liquefying a gas selected from air and components thereof comprising:

a compressor having an inlet and an outlet for compressing a combined feed and recycle gas stream to provide a compressed gas stream from said outlet;

heat exchange means for cooling a portion of said compressed gas stream to a first temperature to provide an "intermediately" cooled compressed gas stream;

a "warm" expansion turbine for work expanding said intermediately cooled compressed gas stream to provide a first expanded gas stream, said "warm" expansion turbine being mounted on a pinion that is mechanically linked by a gear drive to a compressor to provide a portion of the mechanical power required to drive the compressor;

heat exchange means for cooling said first expanded gas stream to a second temperature below said first temperature to provide a cooled first expanded gas stream;

a "cold" expansion turbine for work expanding said cooled first expanded gas stream to provide a second expanded gas stream, said "cold" expansion turbine being for operation at the same speed as, but with a higher pressure ratio than, the "warm" expansion turbine and also mounted on said pinion to provide a further portion of the mechanical power required to drive the compressor;

heat exchange means for cooling and at least partially condensing the remaining portion of said compressed gas stream against said second expanded gas stream to provide refrigeration duty for said cooling and condensation to provide a heat exchanged second expanded gas stream; and recycle conduit means for recycling the heat-exchanged second expanded gas stream to the compressor inlet.

48. An apparatus for liquefying a gas selected from air and components thereof comprising:

a compressor having an inlet and an outlet for compressing a combined feed and recycle gas stream to provide a compressed gas stream from said outlet;

heat exchange means for cooling a portion of said compressed gas stream to a first temperature to provide an "intermediately" cooled compressed gas stream;

a "warm" expansion turbine for work expanding said intermediately cooled compressed gas stream to provide a first expanded gas stream, said "warm" expansion turbine being mounted on a first pinion that is mechanically linked by a gear drive to a compressor to provide a portion of the mechanical power required to drive the compressor;

heat exchange means for cooling said first expanded gas stream to a second temperature below said first temperature to provide a cooled first expanded gas stream;

a "cold" expansion turbine for work expanding said cooled first expanded gas stream to provide a second expanded gas stream, said "cold" expansion turbine being mounted on a second pinion that is mechanically linked to the compressor by the gear drive to provide a further portion of the mechanical power required to drive the compressor;

heat exchange means for cooling and at least partially condensing the remaining portion of said compressed gas stream against said second expanded gas stream to together provide refrigeration duty for said cooling and condensation to provide a heat exchanged second expanded gas stream; and recycle conduit means for recycling the heat-exchanged second expanded gas stream to the compressor inlet.

49. An apparatus for liquefying a gas selected from air and components thereof comprising:

a compressor having at least a first compression section and a final compression section compressing a combined feed and recycle gas stream to provide a first compressed gas stream upstream of said final compression section and a second compressed gas stream from said final compression section;

heat exchange means for cooling said first compressed gas stream to a first temperature to provide an "intermediately" cooled compressed gas stream;

a "warm" expansion turbine for work expanding said intermediately cooled compressed gas stream to provide a first expanded gas stream, said "warm" expansion turbine being mounted on a pinion that is mechanically linked by a gear drive to the compressor to provide a portion of the mechanical power required to drive the compressor;

heat exchange means for cooling a portion of said second compressed gas stream to a second temperature below said first temperature to provide a second cooled compressed gas stream;

a "cold" expansion turbine for work expanding said second cooled compressed gas stream to provide a second expanded gas stream, said "cold" expansion turbine being for operation at the same speed as, but with a higher pressure ratio than, the "warm" expansion turbine and also mounted on said pinion to provide a further portion of the mechanical power required to drive the compressor;

heat exchange means for cooling and at least partially condensing the remaining portion of said second compressed gas stream against said first and second expanded gas streams to together provide refrigeration duty for cooling and condensation to provide heat exchanged first and second expanded gas streams; and recycle conduit means for recycling both the heat-exchanged first expanded gas stream and the heat-exchanged second expanded gas stream to the first compression section.

50. An apparatus for liquefying a gas selected from air and components thereof comprising:

a compressor having at least a first compression section and a final compression section compressing a combined feed and recycle gas stream to provide a first compressed gas stream upstream of said final compression section and a second compressed gas stream from said final compression section;

heat exchange means for cooling said first compressed gas stream to a first temperature to provide an "intermediately" cooled compressed gas stream;

a "warm" expansion turbine for work expanding said intermediately cooled compressed gas stream to provide a first expanded gas stream, said "warm" expansion turbine being mounted on a first pinion that is mechanically linked by a gear drive to the compressor to provide a portion of the mechanical power required to drive the compressor;

heat exchange means for cooling a portion of said second compressed gas stream to a second temperature below said first temperature to provide a second cooled compressed gas stream;

a "cold" expansion turbine for work expanding said second cooled compressed gas stream to provide a second expanded gas stream, said "cold" expansion turbine being mounted on a second pinion that is mechanically linked by the gear drive to the compressor to provide a further portion of the mechanical power required to drive the compressor;

heat exchange means for cooling and at least partially condensing the remaining portion of said second compressed gas stream against said first and second expanded gas streams to together provide refrigeration duty for cooling and condensation to provide heat exchanged first and second expanded gas streams; and recycle conduit means for recycling both the heat-exchanged first expanded gas stream and the heat-exchanged second expanded gas stream to the first compression section.

* * * * *